US010317168B2

(12) United States Patent
Turnbull

(10) Patent No.: US 10,317,168 B2
(45) Date of Patent: Jun. 11, 2019

(54) SYSTEMS AND METHODS FOR FLEXIBLY ADAPTING SWIVELS TO SLINGS

(71) Applicant: William J. Turnbull, Castro Valley, CA (US)

(72) Inventor: William J. Turnbull, Castro Valley, CA (US)

( * ) Notice: Subject to any disclaimer, the term of this patent is extended or adjusted under 35 U.S.C. 154(b) by 0 days.

(21) Appl. No.: 15/493,052

(22) Filed: Apr. 20, 2017

(65) Prior Publication Data

US 2017/0307329 A1 Oct. 26, 2017

Related U.S. Application Data

(60) Provisional application No. 62/326,705, filed on Apr. 22, 2016.

(51) Int. Cl.
*F41C 33/00* (2006.01)
*F41C 23/02* (2006.01)

(52) U.S. Cl.
CPC ..... *F41C 33/002* (2013.01); *F41C 23/02* (2013.01)

(58) Field of Classification Search
CPC ..... F41C 33/002; F41C 23/02
USPC ..... 224/150
See application file for complete search history.

(56) References Cited

U.S. PATENT DOCUMENTS 4,511,070 A 4/1985 Hightower
4,823,998 A 4/1989 Johnson
5,067,267 A * 11/1991 Ives ..... F41C 23/02 224/150
5,433,360 A * 7/1995 Rock ..... A44B 11/25 224/150
5,810,219 A * 9/1998 Rosenfield ..... F41C 33/001 224/149
6,068,167 A 5/2000 Hopson
6,581,812 B2 * 6/2003 Roscoe-Dare ..... A45F 3/14 224/257
6,749,099 B2 * 6/2004 Danielson ..... A45F 5/02 224/250
7,270,254 B2 * 9/2007 Kakouras ..... F41C 23/02 224/150
7,562,481 B2 * 7/2009 Esch ..... F41C 23/02 224/150
7,959,046 B2 * 6/2011 Burnsed, Jr. ..... F41C 33/001 224/150

(Continued)

OTHER PUBLICATIONS

USPTO, ISA/US, "Notification of Transmittal of the ISR and the Written Opinion of the International Searching Authority, or the Declaration," in PCT Application No. PCT/US2017/028959, dated Jul. 10, 2017, 7 pages.

*Primary Examiner* — Peter N Helvey
(74) *Attorney, Agent, or Firm* — Kang S. Lim

(57) ABSTRACT

Systems and methods for coupling different types of firearm sling swivels to a variety of detachable slings are provided. In one embodiment, the sling adapter includes an adapter subassembly, a first loop channel, a second loop channel and a strap. The adapter subassembly includes a pin and an adapter body with a pin hole and a swivel hole. The pin is inserted into the pin hole of the adapter body. The swivel hole securely accommodates a detachable firearm's sling. The strap includes a first loop segment, a first pin segment, a second loop segment, a swivel segment, a third loop segment, a second pin segment and a fourth loop segment.

13 Claims, 13 Drawing Sheets

(56) References Cited

U.S. PATENT DOCUMENTS

| | | | | |
|---|---|---|---|---|
| 8,430,285 | B2 * | 4/2013 | Burnsed, Jr. | F41C 23/02 224/150 |
| 9,157,700 | B1 * | 10/2015 | Hansen | F41C 33/002 |
| 9,291,425 | B2 * | 3/2016 | Golob | F41C 33/001 |
| 9,494,383 | B2 * | 11/2016 | Kharlampov | F41C 33/002 |
| 9,557,138 | B2 * | 1/2017 | Alford | F41C 33/00 |
| 9,885,540 | B2 * | 2/2018 | Bennett | F41C 33/002 |
| 9,915,499 | B2 * | 3/2018 | Alford | F41C 33/002 |
| 2002/0195830 | A1 | 12/2002 | Gotz et al. | |
| 2006/0260725 | A1 | 11/2006 | Kawakita | |

* cited by examiner

SYSTEMS AND METHODS FOR FLEXIBLY ADAPTING SWIVELS TO SLINGS

CROSS-REFERENCE TO RELATED APPLICATION

This non-provisional application claims the benefit of U.S. provisional application No. 62/326,705 filed on Apr. 22, 2016, of the same title, which application is hereby fully incorporated in its entirety by this reference.

BACKGROUND

The present invention relates to systems and methods for adapting different firearm swivels to a wide variety of firearm slings.

Because of the diverse variety of firearms with a wide range of swivels, adapters are needed to couple these firearms to particular slings. In addition, collectors are often reluctant to modify classic collectable firearms to avoid adversely affecting their values.

It is therefore apparent that an urgent need exists for flexibly adapting different firearm swivels to a wide variety of firearm slings. These improved sling adapters enable collectors and enthusiasts to attach a relatively small set of slings to a wide variety of firearms without having to own a correspondingly large number of slings.

SUMMARY

To achieve the foregoing and in accordance with the present invention, systems and methods for adapting firearm swivels to a wide variety of firearm slings, including detachable slings, are provided.

In one embodiment, a sling adapter includes an adapter subassembly, a first loop channel, a second loop channel and a strap. The adapter subassembly has an adapter body having a pin hole and a swivel hole. The swivel hole securely accommodates one end of a detachable firearm's sling. The pin is inserted into the pin hole of the adapter body.

The strap includes a first loop segment, a first pin segment, a second loop segment, a swivel segment, a third loop segment, a second pin segment and a fourth loop segment. The first loop segment is configured to be inside the first loop channel. The first pin segment includes a hole configured to securely accommodate the adapter body. The second loop segment is configured to be inside the second loop channel.

In this embodiment, during assembly, the swivel segment is looped through a firearm sling swivel. Next, the third loop segment is configured to be inserted through the second loop channel. The second pin segment includes a hole configured to securely accommodate the adapter body. Finally, the fourth loop segment is inserted through the second loop channel.

Note that the various features of the present invention described above may be practiced alone or in combination. These and other features of the present invention will be described in more detail below in the detailed description of the invention and in conjunction with the following figures.

BRIEF DESCRIPTION OF THE DRAWINGS

In order that the present invention may be more clearly ascertained, some embodiments will now be described, by way of example, with reference to the accompanying drawings, in which.

DETAILED DESCRIPTION

The present invention will now be described in detail with reference to several embodiments thereof as illustrated in the accompanying drawings. In the following description, numerous specific details are set forth in order to provide a thorough understanding of embodiments of the present invention. It will be apparent, however, to one skilled in the art, that embodiments may be practiced without some or all of these specific details. In other instances, well known process steps and/or structures have not been described in detail in order to not unnecessarily obscure the present invention. The features and advantages of embodiments may be better understood with reference to the drawings and discussions that follow.

Aspects, features and advantages of exemplary embodiments of the present invention will become better understood with regard to the following description in connection with the accompanying drawing(s). It should be apparent to those skilled in the art that the described embodiments of the present invention provided herein are illustrative only and not limiting, having been presented by way of example only. All features disclosed in this description may be replaced by alternative features serving the same or similar purpose, unless expressly stated otherwise. Therefore, numerous other embodiments of the modifications thereof are contemplated as falling within the scope of the present invention as defined herein and equivalents thereto. Hence, use of absolute and/or sequential terms, such as, for example, "always," "will," "will not," "shall," "shall not," "must," "must not," "first," "initially," "next," "subsequently," "before," "after," "lastly," and "finally," are not meant to limit the scope of the present invention as the embodiments disclosed herein are merely exemplary.

The present invention relates to systems and methods for flexibly adapting firearm swivels of different firearms to a wide variety of firearm slings, including detachable slings, thereby avoiding having to own a correspondingly large number of customized slings.

To facilitate discussion, FIGS. 1A, 1B, 1C and 1D are an assembled side view, an assembled cross-sectional view, a partially assembled side view and an assembled front view, respectively, illustrating the assembly of one embodiment of a firearm sling adapter 100 in accordance with the present invention.

Figure 1A:
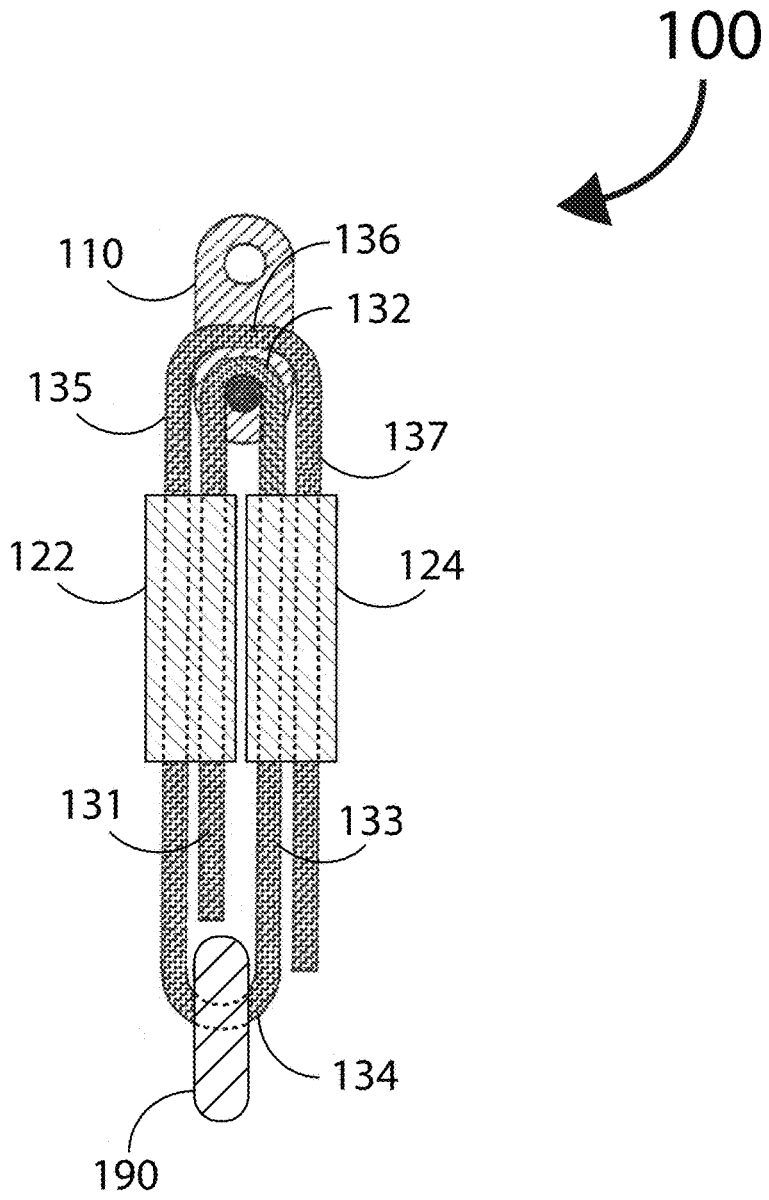
FIGS. 1A, 1B, 1C and 1D are an assembled side view, an assembled cross-sectional view, a partially assembled side view and an assembled front view, respectively, illustrating the assembly of one embodiment of a firearm sling adapter in accordance with the present invention.
Figure 1B:
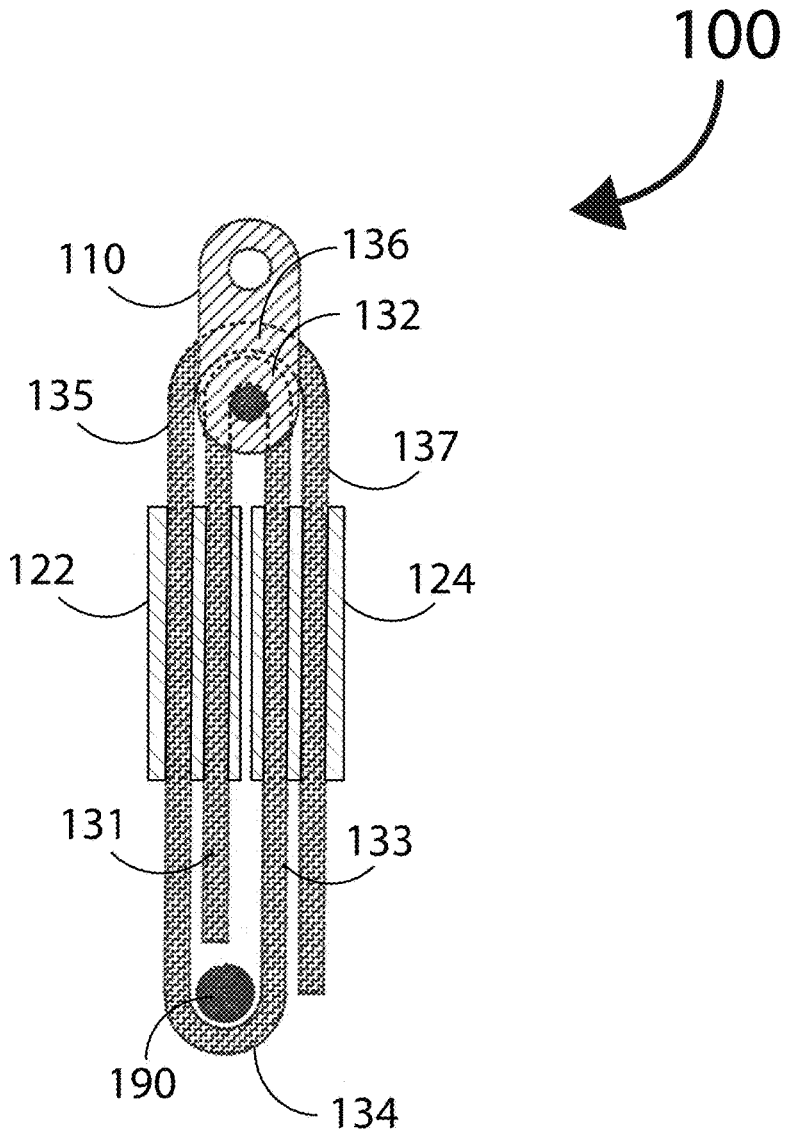
Figure 1C:
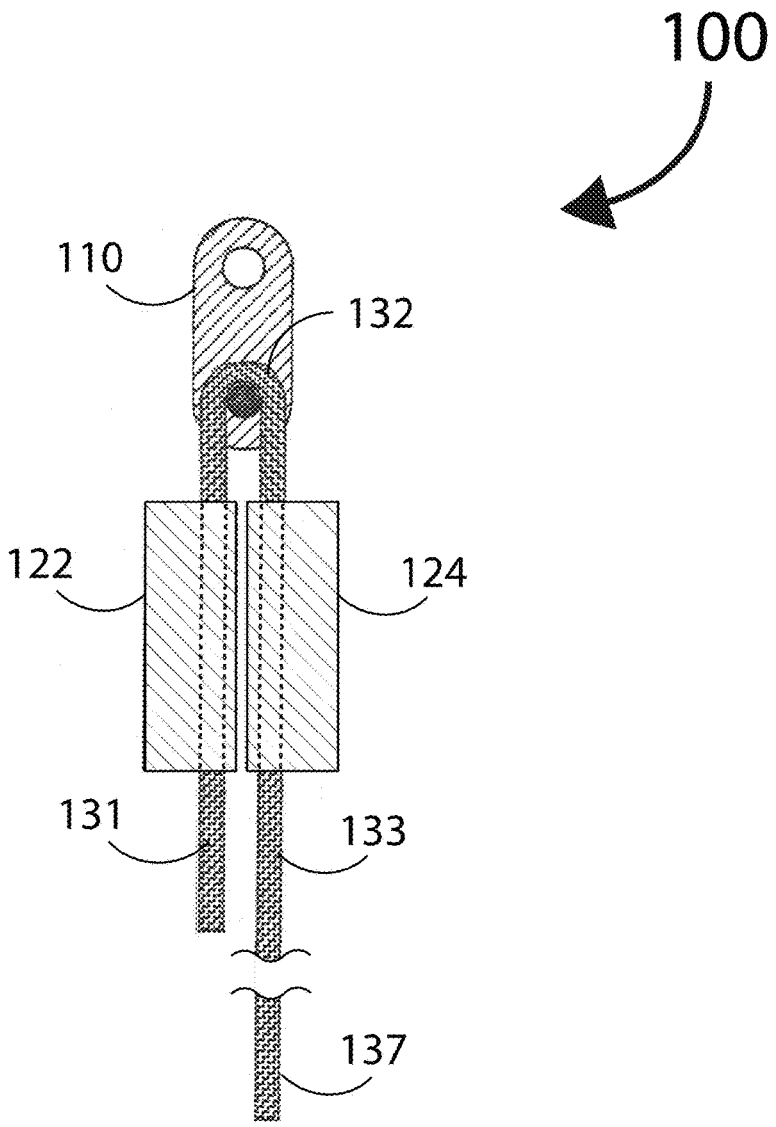
Figure 1D:
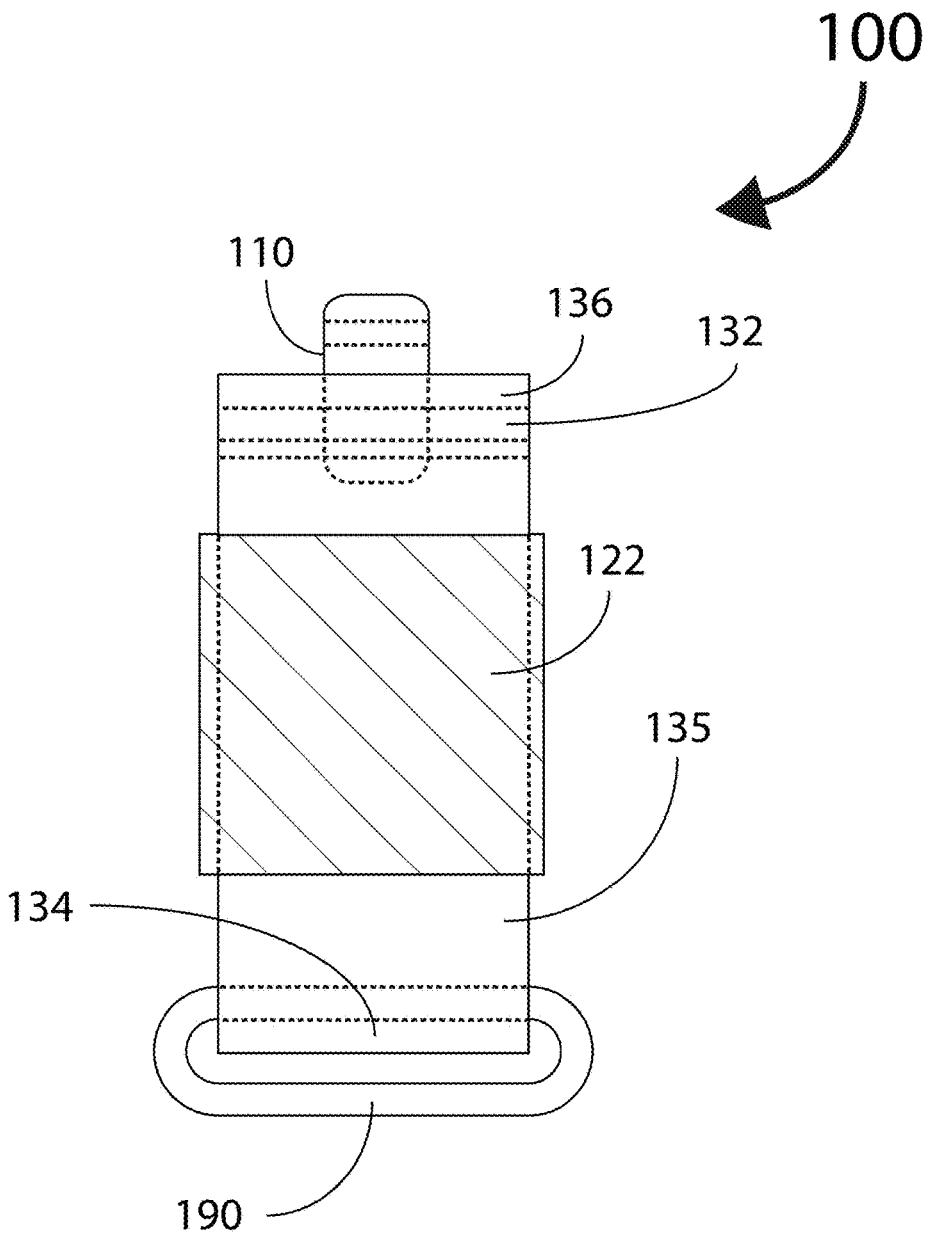

In this embodiment as shown in FIGS. 1A and 1D, detachable firearm sling adapter 100 is configured to couple a firearm sling swivel 190 to a detachable firearms sling (not shown in FIGS. 1A-1D). The sling adapter includes an adapter subassembly, a first loop channel 122, a second loop channel 124, and a strap made from a suitable flexible material such as nylon webbing. The strap includes a first loop segment 131, a first pin segment 132, a second loop segment 133, a swivel segment 134, a third loop segment 135, a second pin segment 136 and a fourth loop segment 137.

The loop channels 122, 124 and the strap can be made from suitable flexible material such as nylon, polyester or canvas webbing. The first and second loop channels 122, 124 can also be coupled to each other, e.g., stitched together. In addition, the ends and/or holes of webbing can also be hot-cut, reinforced and/or heat-sealed to minimized fraying.

Figure 2:
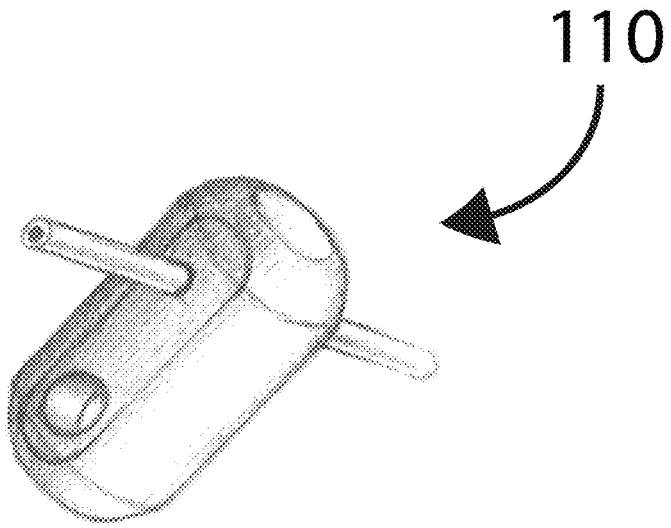
FIG. 2 is a perspective view of a subassembly of the firearm sling adapter of FIGS. 1A-1D.

Referring to both FIG. 1A and the perspective view of FIG. 2, the adapter subassembly includes a cross pin 114 and an adapter body 110 with a pin hole and a swivel hole 112. The pin 114 is configured to be inserted into the pin hole of the adapter body 110. The swivel hole 112 is configured to securely accommodate one end of an exemplary detachable firearms sling 410 (shown in FIG. 4).

As shown in FIG. 1C, the first loop segment 131 is configured to be located substantially inside the first loop channel 122. The first pin segment 132 includes a hole configured to securely accommodate the adapter body 110. The second loop segment 133 is configured to be located inside the second loop channel 124.

Figure 3A:
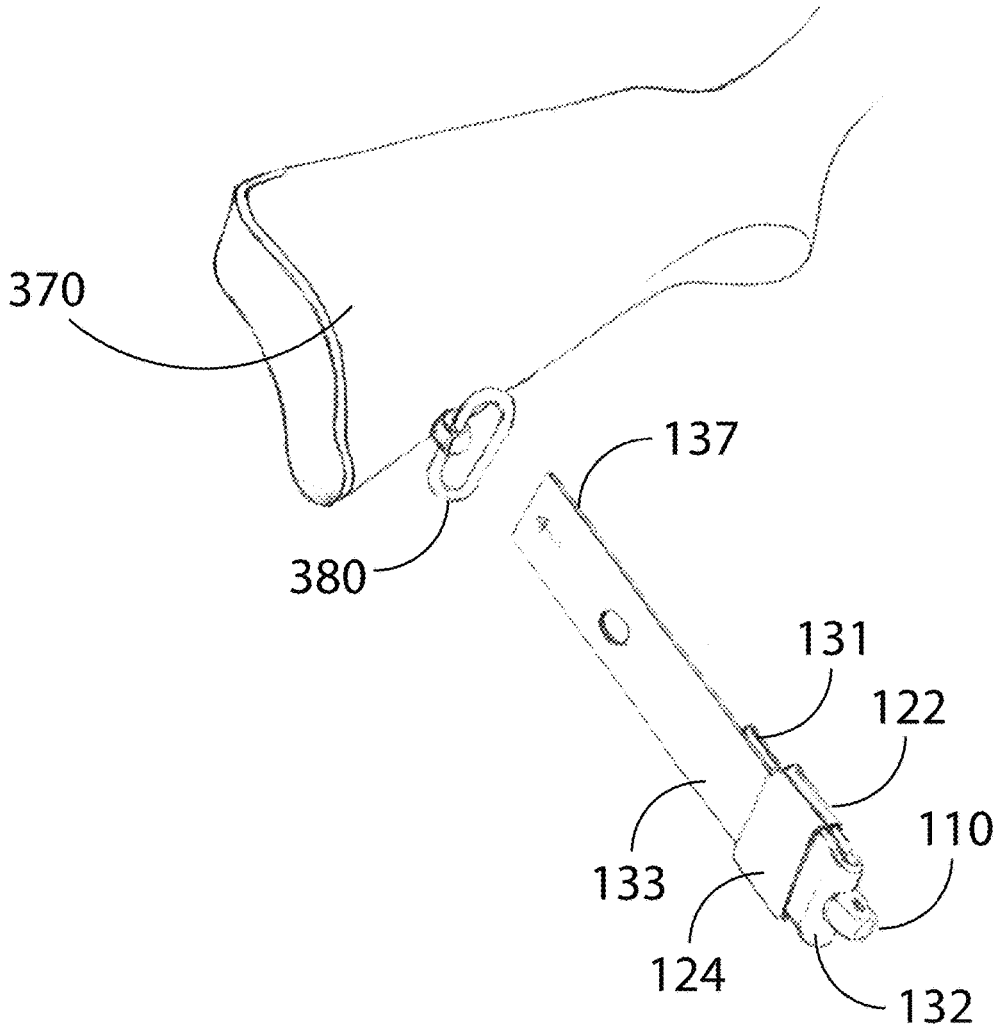
FIGS. 3A-3E are perspective views illustrating the assembly of the firearm sling adapter of FIGS. 1A-1D thereby coupling with a firearm swivel.
Figure 3B:
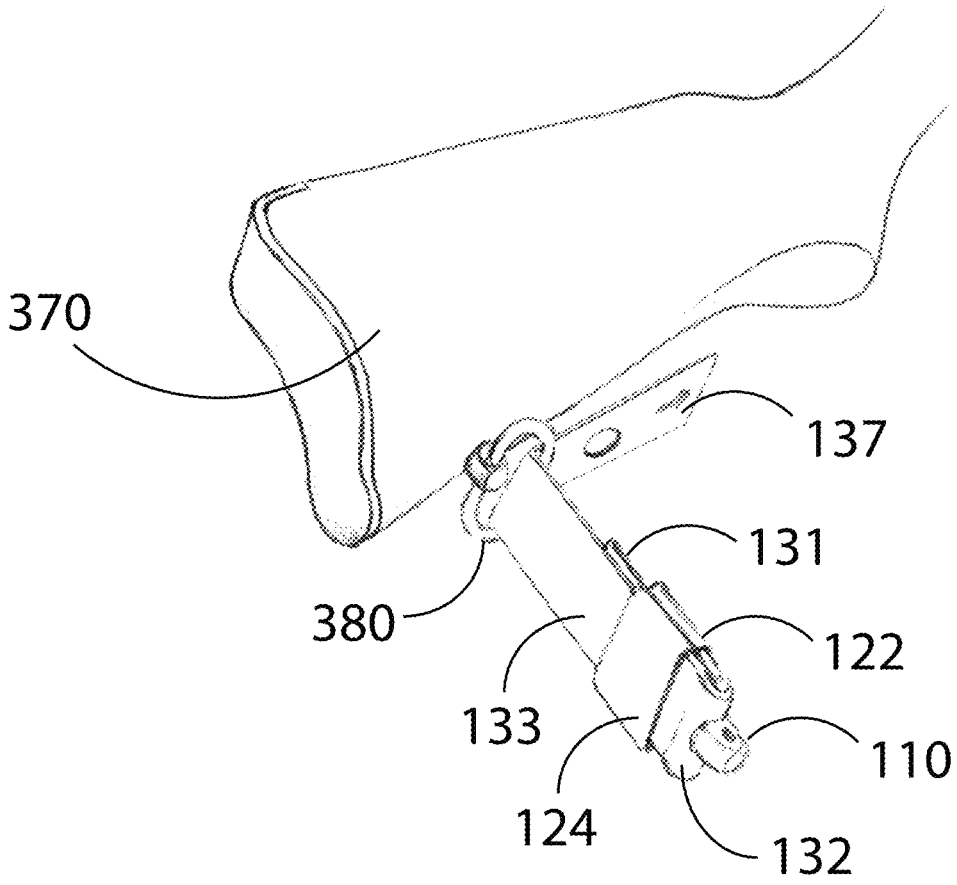

Referring back to FIGS. 1A-1B and also to the perspective views of FIGS. 3A-3B, the swivel segment 134 is looped through a firearm sling swivel 190. In this example, swivel 190 can be sling swivel 380 of firearm 370.

Figure 3C:
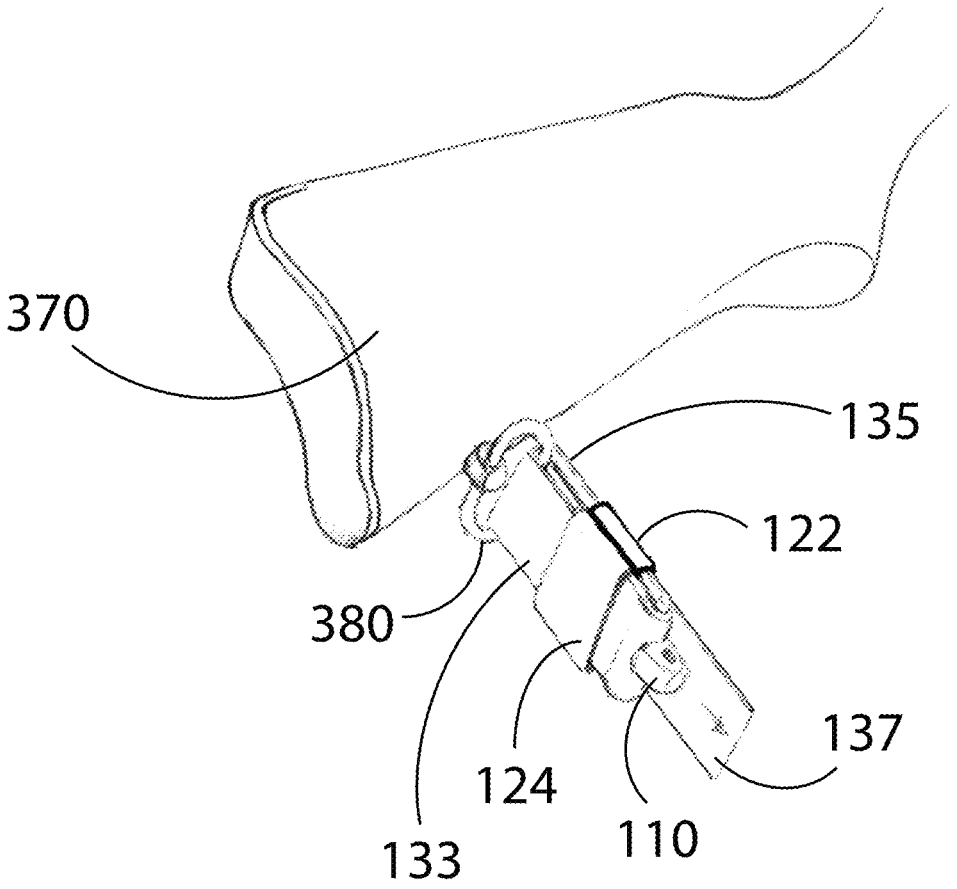
Figure 3D:
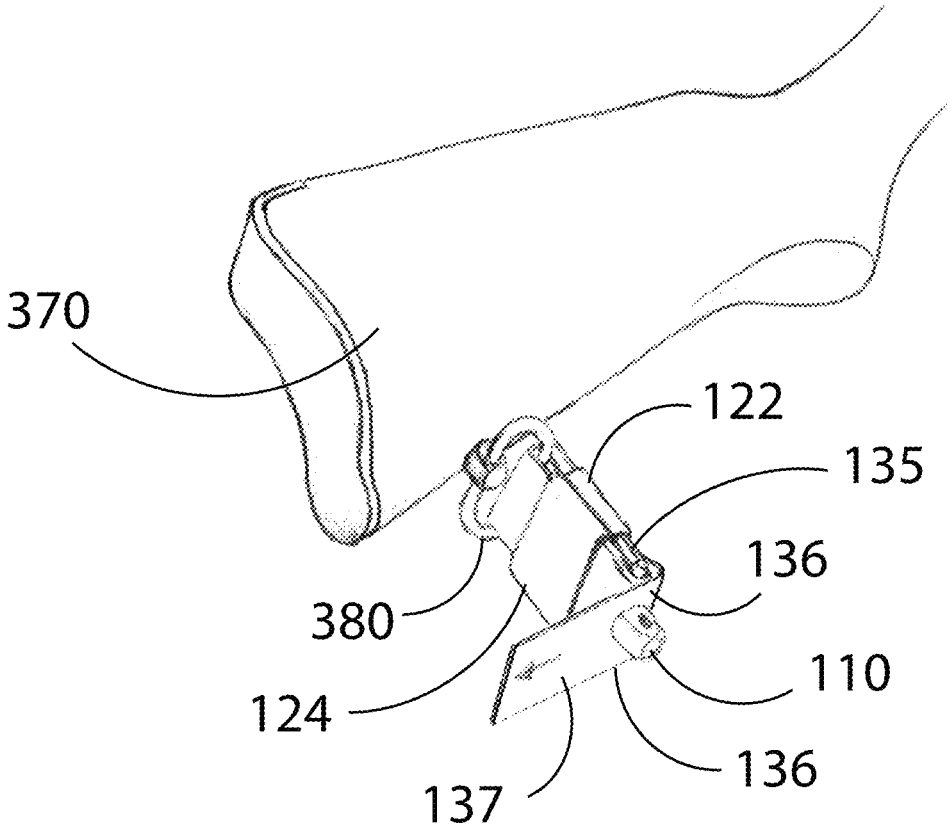

The third loop segment 135 can now be inserted through the second loop channel 124 thereby forming a closed loop over swivel 380 (see FIG. 3C). Next, as shown in FIG. 3D, a hole of the second pin segment 136 is securely fitted over adapter body 110.

Figure 3E:
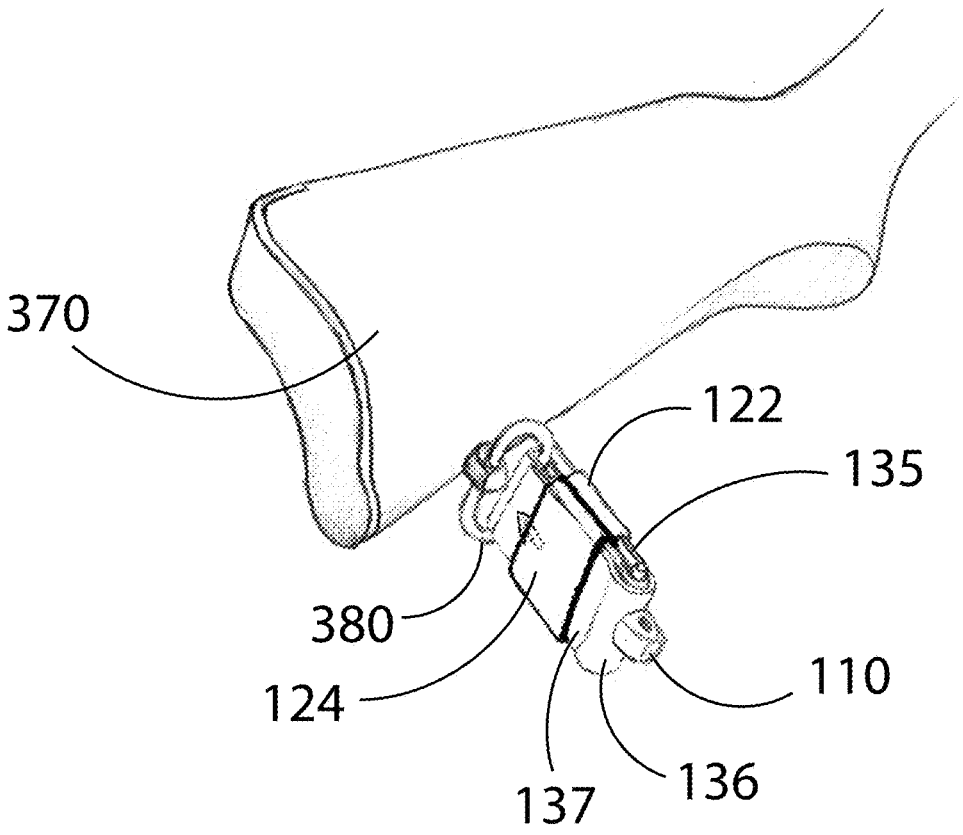
Figure 4:
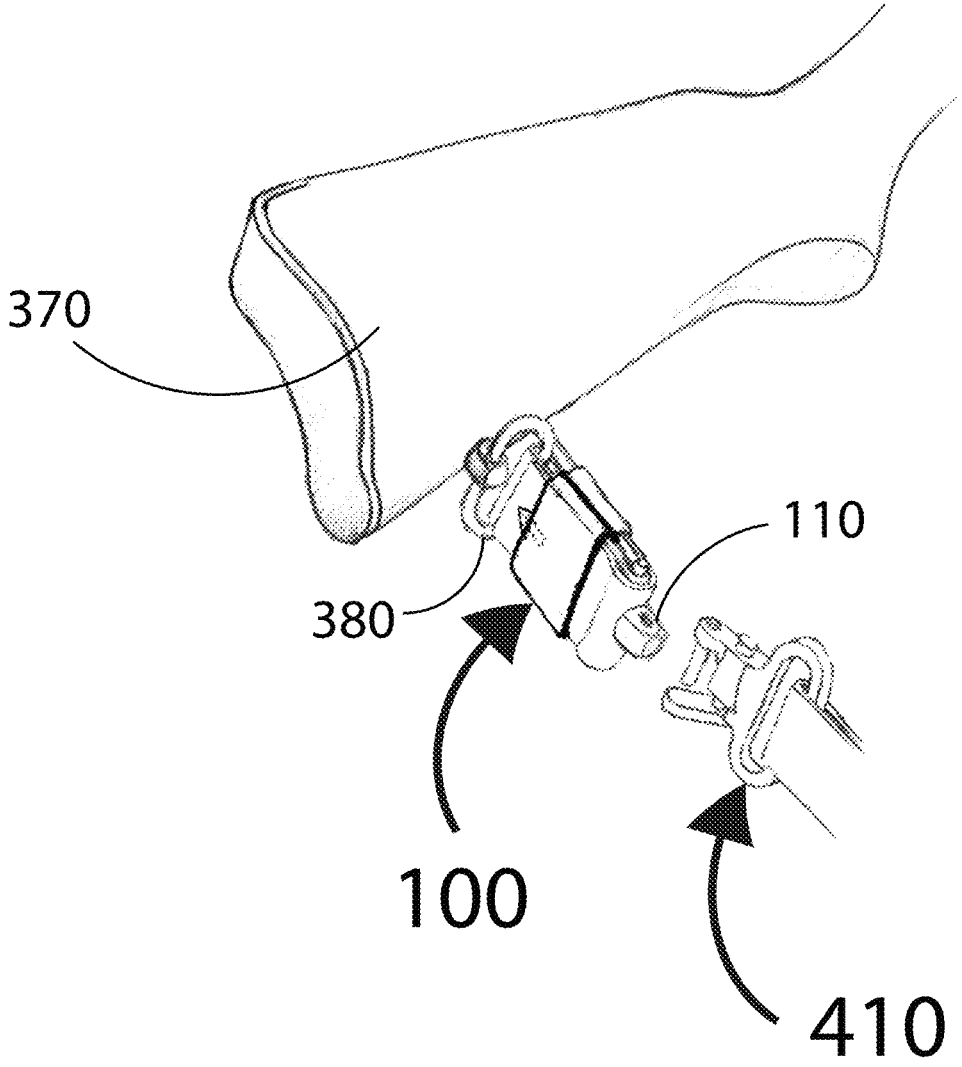
FIG. 4 is a perspective view depicting how the firearm sling adapter of FIGS. 1A-1D can be attached to a firearm sling.

The fourth loop segment 137 is then inserted inside the second loop channel 124, thereby completing the assembly of sling adapter 100, and enabling the sling swivel 380 of firearm 370 to be securely coupled to a detachable sling 410 to using the sling adapter 100 (see both FIGS. 3E and 4).

Figure 6:
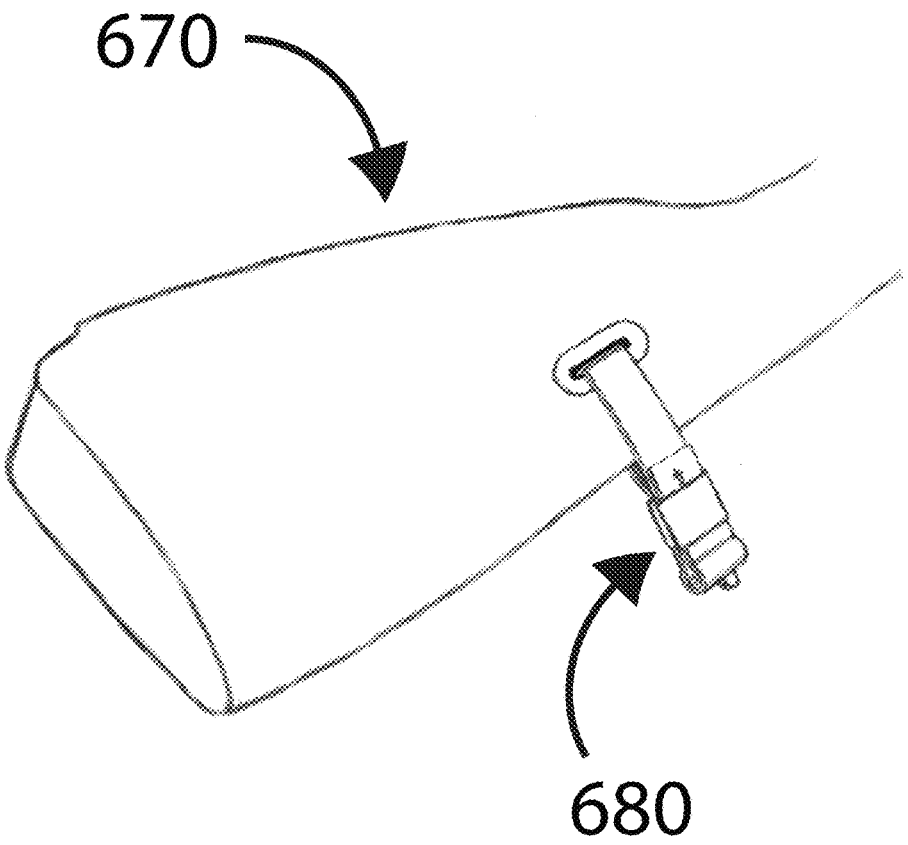
FIG. 6 is a perspective view depicting an alternative application of the firearm sling adapter of FIGS. 1A-1D.

In another embodiment, as illustrated by FIG. 6, instead of coupling to a firearm sling swivel, a firearm 670 can be coupled to a firearm sling by inserting the strap of a sling adapter 680 directly through a corresponding slot machined into a buttstock of firearm 670.

Figure 5:
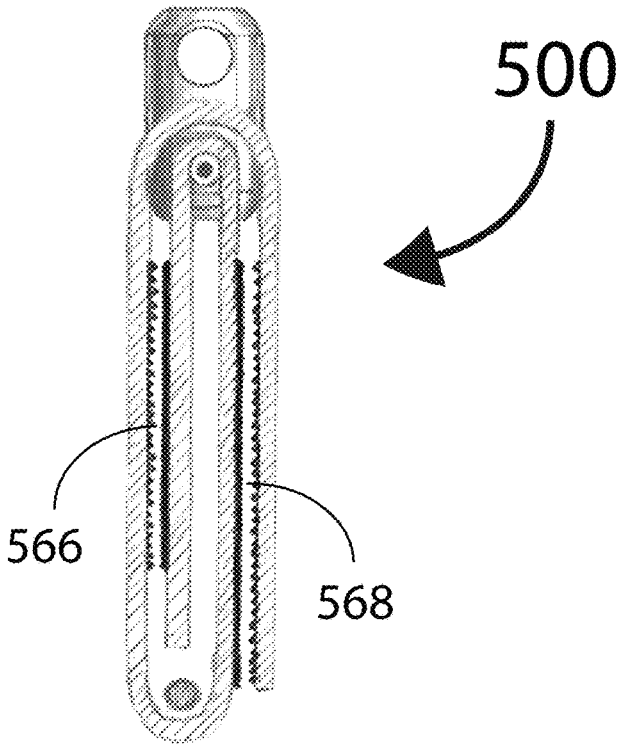
FIG. 5 is a cross-sectional view illustrating another embodiment of a firearm sling adapter in accordance with the present invention.

Many modifications and additions to the above described embodiment of adapter 100 are possible. For example, as shown in FIG. 5, hook and loop fasteners 566, 568 are functional substitutes for the loop channels 122, 124. The first and second loop channels 122, 124 can be made from a suitable rigid material such as plastic, fiberglass, carbon fiber or aluminum.

While this invention has been described in terms of several embodiments, there are alterations, modifications, permutations, and substitute equivalents, which fall within the scope of this invention. Although sub-section titles have been provided to aid in the description of the invention, these titles are merely illustrative and are not intended to limit the scope of the present invention.

It should also be noted that there are many alternative ways of implementing the methods and apparatuses of the present invention. It is therefore intended that the following appended claims be interpreted as including all such alterations, modifications, permutations, and substitute equivalents as fall within the true spirit and scope of the present invention.

What is claimed is:

1. A detachable firearm sling adapter configured to couple a firearm sling swivel to a detachable firearm sling, the sling adapter comprising:

an adapter subassembly having:

an adapter body having a pin hole and a swivel hole, wherein the swivel hole is configured to securely accommodate one end of a detachable firearm sling; and a pin configured to be inserted into the pin hole of the adapter body;

a first loop channel;

a second loop channel; and a strap having a first loop segment, a first pin segment, a second loop segment, a swivel segment, a third loop segment, a second pin segment and a fourth loop segment, wherein the first loop segment is configured to be inside the first loop channel, wherein the first pin segment includes a first centered through hole vertically oriented and completely penetrating the first pin segment, the first centered through hole configured to securely accommodate the adapter body when assembled vertically through the first centered through hole hereby preventing slippage of the adapter body relative to the first pin segment, wherein the second loop segment is configured to be inside the second loop channel, wherein the swivel segment is configured to be looped through a firearm sling swivel, wherein the third loop segment is configured to be inside the second loop channel, wherein the second pin segment includes a second centered through hole vertically oriented and completely penetrating the second pin segment, the second centered through hole configured to securely accommodate the adapter body when assembled vertically through the second pin segment hereby preventing slippage of the adapter body relative to the second pin segment, wherein the fourth loop segment is configured to be inside the second loop channel, wherein the first pin segment is configured to be adjacent to the pin when assembled, wherein the second pin segment is configured to be adjacent to the first pin segment when assembled, wherein the first pin segment is configured to be between the pin and the second pin segment when assembled, and wherein the strap includes a contiguous sequence comprising of the first loop segment, a first pin segment, a second loop segment, a swivel segment, a third loop segment, a second pin segment and a fourth loop segment forming a spiral, with the first loop segment innermost and the fourth loop segment outermost.

2. The sling adapter of claim 1 wherein the first loop segment is coupled to the first loop channel, wherein the first pin segment is coupled to the adapter body, and wherein the second loop segment is coupled to the second loop channel.

3. The sling adapter of claim 1 wherein the strap are made from a flexible material.

4. The sling adapter of claim 3 wherein the flexible material is nylon webbing.

5. The sling adapter of claim 1 wherein the first and second loop channels are coupled to each other.

6. The sling adapter of claim 1 wherein the first and second loop channels are made from a flexible material.

7. The sling adapter of claim 6 wherein the flexible material is webbing.

8. The sling adapter of claim 7 wherein the webbing comprises at least one of nylon, polyester and canvas.

9. The sling adapter of claim 1 wherein the first and second loop channels are made from a flexible material.

10. The sling adapter of claim 9 wherein the flexible material is webbing.

11. The sling adapter of claim 10 wherein the webbing comprises at least one of nylon, polyester and canvas.

12. The sling adapter of claim 1 wherein the first and second loop channels are made from a rigid material.

13. The sling adapter of claim 12 wherein the rigid material comprises at least one of plastic, fiberglass, carbon fiber and aluminum.

* * * * *